US010424881B2

(12) United States Patent
Chen et al.

(10) Patent No.: US 10,424,881 B2
(45) Date of Patent: Sep. 24, 2019

(54) RECEPTACLE ELECTRICAL CONNECTOR

(71) Applicant: Advanced Connectek Inc., New Taipei (TW)

(72) Inventors: Mao-Sheng Chen, New Taipei (TW); Hsu-Fen Wang, New Taipei (TW); Chih-Kang Chen, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 15/832,782

(22) Filed: Dec. 6, 2017

(65) Prior Publication Data

US 2018/0205185 A1 Jul. 19, 2018

(30) Foreign Application Priority Data

Jan. 16, 2017 (TW) ..... 106200785 A

(51) Int. Cl.

| | |
|---|---|
| ***H01R 13/648*** | (2006.01) |
| ***H01R 13/6594*** | (2011.01) |
| ***H01R 24/60*** | (2011.01) |
| ***H01R 12/70*** | (2011.01) |
| ***H01R 12/72*** | (2011.01) |
| *H01R 107/00* | (2006.01) |

(52) U.S. Cl.

CPC ..... *H01R 13/6594* (2013.01); *H01R 12/7082* (2013.01); *H01R 12/724* (2013.01); *H01R 24/60* (2013.01); *H01R 2107/00* (2013.01)

(58) Field of Classification Search

CPC ..... H01R 13/6594; H01R 13/6585; H01R 13/502; H01R 12/7082; H01R 24/60

USPC ..... 439/607.35

See application file for complete search history.

(56) References Cited

U.S. PATENT DOCUMENTS

| | | | | |
|---|---|---|---|---|
| 9,853,399 | B2 * | 12/2017 | Kao | H01R 13/6585 |
| 9,865,974 | B2 * | 1/2018 | Chen | H01R 24/62 |
| 2016/0013593 | A1 * | 1/2016 | Kao | H01R 13/6585 439/607.01 |
| 2016/0104975 | A1 * | 4/2016 | Guo | H01R 13/6585 439/607.05 |
| 2016/0352050 | A1 * | 12/2016 | Hu | H01R 13/6597 |
| 2017/0040721 | A1 * | 2/2017 | Tsai | H01R 13/502 |
| 2017/0077652 | A1 * | 3/2017 | Chen | H01R 13/405 |

* cited by examiner

*Primary Examiner* — Jean F Duverne
(74) *Attorney, Agent, or Firm* — JCIPRNET

(57) ABSTRACT

An electrical receptacle connector includes a shielding shell, an insulating body and a plurality of terminals. The shielding shell has a front opening, a bottom opening and an electrical connecting portion. The electrical connecting portion is located between the front opening and the bottom opening. The insulating body is disposed inside the shielding shell and has a tongue. The tongue is exposed to the front opening. The terminals are disposed at the insulating body. Each of the terminals has a contact segment and a soldering segment. The contact segment is located on the tongue, and the soldering segment is extended from the insulating body, exposed to the bottom opening and arranged in double rows.

13 Claims, 6 Drawing Sheets

RECEPTACLE ELECTRICAL CONNECTOR

CROSS-REFERENCE TO RELATED APPLICATION

This application claims the priority benefit of Taiwan patent application serial no. 106200785, filed on Jan. 16, 2017. The entirety of the above-mentioned patent application is hereby incorporated by reference herein and made a part of the specification.

BACKGROUND OF THE INVENTION

Field of the Invention

The invention relates to an electrical connector and particularly relates to an electrical receptacle connector.

Description of Related Art

An electrical connector is a common component on an electronic device and can be connected to a matched electrical connector on another electronic device so as to serve as a medium for transmitting signals and electricity between the two electronic devices. A common type of electrical connector is, for example, a universal serial bus (USB). To prevent external electromagnetic interference (EMI) and to block electromagnetic interference generated during signal transmission, the electrical connector usually has a shielding shell to drain these electromagnetic interference to the ground.

SUMMARY OF THE INVENTION

The invention provides an electrical receptacle connector configured to be installed in an electronic device so as to be connected to a matched electrical plug connector.

An electrical receptacle connector of the invention includes a first shielding shell, an insulating body and a plurality of terminals. The first shielding shell has a front opening, a bottom opening and an electrical connecting portion. The electrical connecting portion is located between the front opening and the bottom opening. The insulating body is disposed inside the first shielding shell and has a tongue. The tongue is exposed to the front opening. The terminals are disposed at the insulating body. Each of the terminals has a contact segment and a soldering segment. The contact segment is located on the tongue, and the soldering segment is extended from the insulating body, exposed to the bottom opening and arranged in double rows.

In an embodiment of the invention, the first shielding shell further has a bottom wall. The bottom wall is located between the front opening and the bottom opening, and the electrical connecting portion is located on the bottom wall.

In an embodiment of the invention, the electrical connecting portion is closer to the bottom opening than to the front opening.

In an embodiment of the invention, the electrical connecting portion is closer to the soldering segment than to the front opening.

In an embodiment of the invention, the electrical connecting portion is in the form of a vertical soldering leg, a horizontal soldering leg or a contact protrusion.

In an embodiment of the invention, the first shielding shell further has a plurality of first soldering legs, and the first soldering legs and the electrical connecting portion are located around the bottom opening.

In an embodiment of the invention, the electrical receptacle connector further includes a second shielding shell that surrounds the first shielding shell and has a plurality of second soldering legs. The second soldering legs are located on two opposite sides of the first shielding shell.

In an embodiment of the invention, the electrical receptacle connector meets USB TYPE-C or USB TYPE-A specifications.

Based on the above, in the invention, the shielding shell (namely, the first shielding shell) of the electrical receptacle connector has one or a plurality of electrical connecting portions located between the front opening and the bottom opening of the shielding shell and closer to the bottom opening and the soldering segment. The electrical connecting portion is conducive to shortening a low-impedance path of interference currents so as to reduce EMI noise.

To make the aforementioned and other features and advantages of the invention more comprehensible, several embodiments accompanied with drawings are described in detail as follows.

DESCRIPTION OF THE EMBODIMENTS

Figure 1:
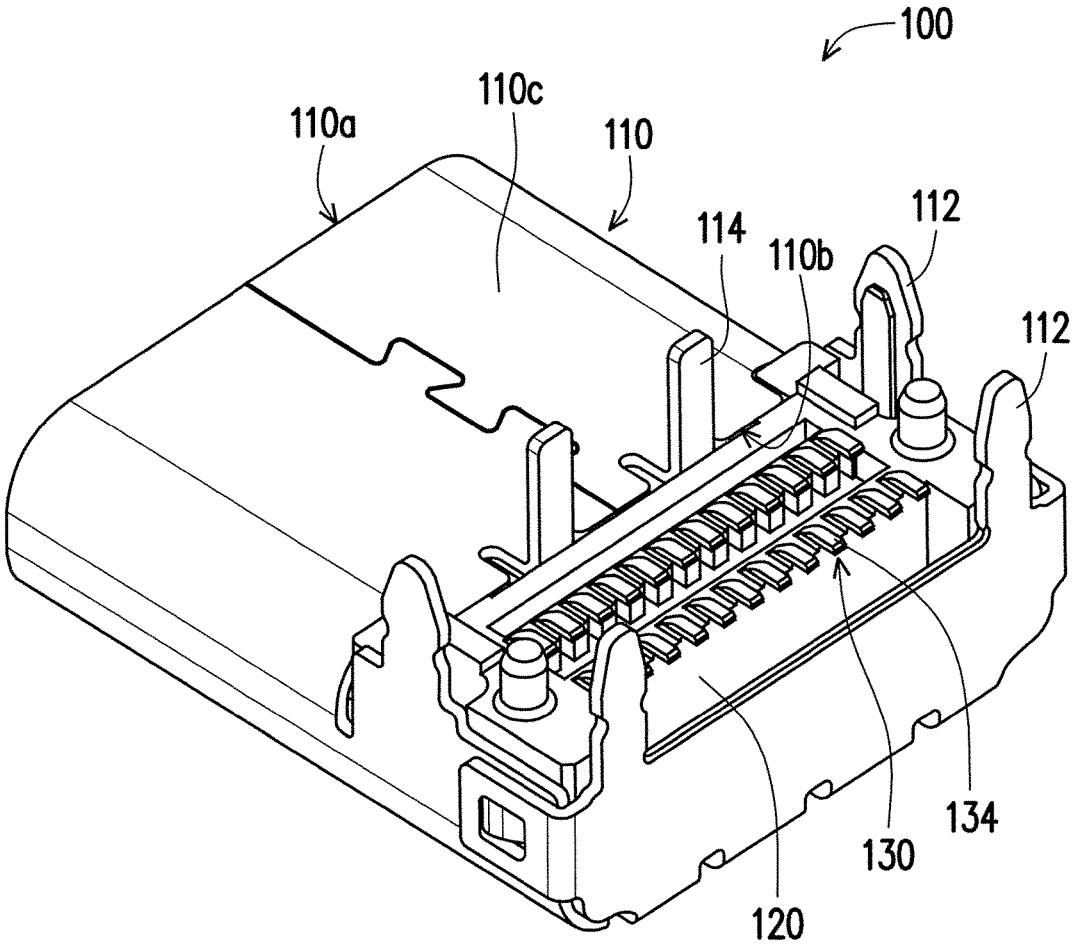
FIG. 1 is a perspective view of an electrical receptacle connector according to an embodiment of the invention.
Figure 2:
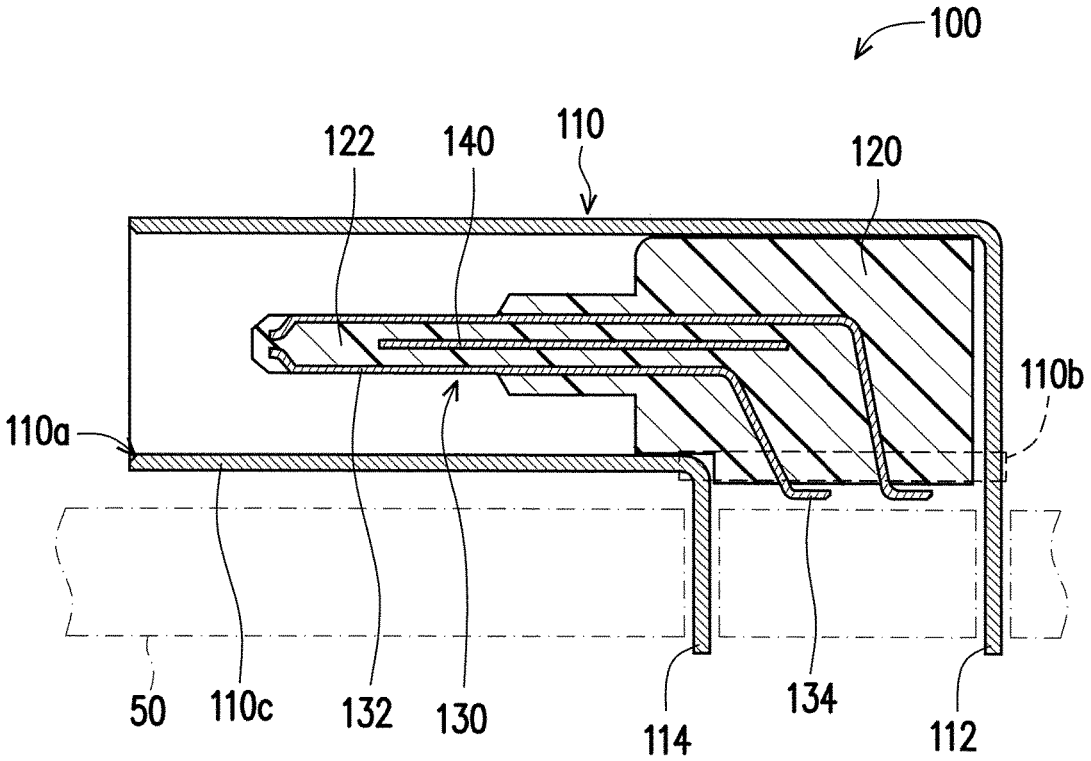
FIG. 2 is a partial sectional view of the electrical receptacle connector of FIG. 1.

Referring to FIG. 1 and FIG. 2, in this embodiment, an electrical receptacle connector 100 complies with, for example, the USB TYPE-C specifications. The electrical receptacle connector 100 is suitable for being mounted on a circuit board 50 shown in FIG. 2. The electrical receptacle connector 100 includes a first shielding shell 110, an insulating body 120 and a plurality of terminals 130. The first shielding shell 110 has a front opening 110*a* and a bottom opening 110*b*. The insulating body 120 is disposed inside the first shielding shell 110 and has a tongue 122. The tongue 122 is exposed to the front opening 110*a*. The terminals 130 are disposed at the insulating body 120. Each of the terminals 130 has a contact segment 132 and a soldering segment 134. The contact segment 132 is located on the tongue 122. The soldering segment 134 is extended out the insulating body 120, exposed to the bottom opening 110*b* and arranged in double rows. The electrical receptacle connector 100 further includes a shielding plate 140 located inside the tongue 122 and disposed between the contact segments 132 of the double rows of the terminals 130. The contact segments 132 of the double rows of the terminals 130 are disposed on an upper surface of the tongue and an lower surface of the tongue 122.

In this embodiment, the first shielding shell 110 has a plurality of first soldering legs 112 that are, for example, vertical soldering legs (namely, DIP soldering legs). The first soldering legs 112 are located on a periphery of the first shielding shell 110 for being inserted and soldered to the circuit board 50. Thus, the first shielding shell 110 drains an interference current to the ground through the soldering legs 112. In another embodiment not shown, the first soldering legs 112 may also be horizontal soldering legs (namely, SMT soldering legs) or other types of soldering legs.

It should be noted that, the first shielding shell 110 has a plurality of electrical connecting portions 114 located between the front opening 110*a* and the bottom opening 110*b*. Specifically, the first shielding shell 110 further has a bottom wall 110*c* located between the front opening 110*a* and the bottom opening 110*b* and facing the circuit board 50. The electrical connecting portions 114 are located on the bottom wall 110*c*. The electrical connecting portions 114 are extended downwardly from the edge of the bottom wall 110*c* and are located between the front opening 110*a* and the bottom opening 110*b*. The first soldering legs 112 and the electrical connecting portions 114 are located around the bottom opening 110*b*. The electrical connecting portions 114 are closer to the bottom opening 110*b* than to the front opening 110*a*, namely, closer to the soldering segment 134 of the terminal 130. Thus, the first shielding shell 110 not only drains the interference current to the ground through the first soldering legs 112, but shortens a low-impedance path of the interference current through the electrical connecting portions 114, so as to reduce EMI noise.

Figure 3A:
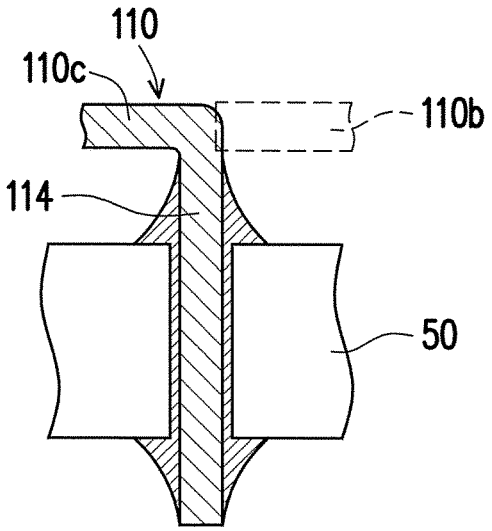
FIG. 3A, FIG. 3B and FIG. 3C are partial sectional views of three different forms of electrical connecting portions of the electrical receptacle connector of FIG. 2 being coupled to a circuit board.
Figure 3B:
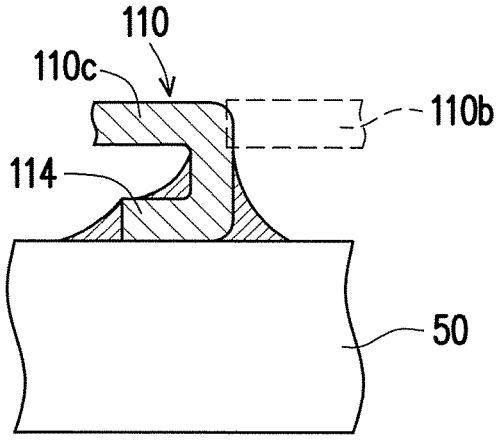
Figure 3C:
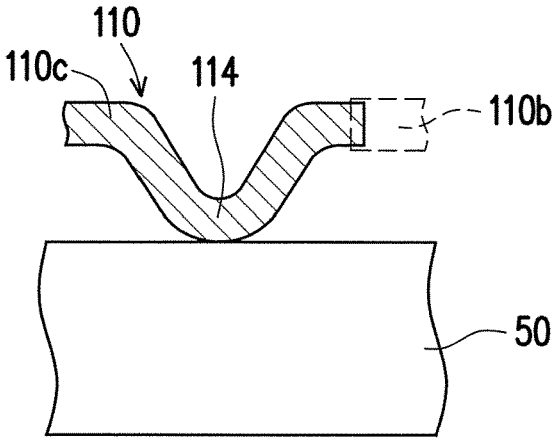

In this embodiment, the electrical connecting portions 114 may be vertical soldering legs (namely, the so-called DIP soldering legs) configured to be mounted on the circuit board 50 by inserting and soldering as shown in FIG. 3A. In addition, the electrical connecting portions 114 may also be horizontal soldering legs (namely, the so-called SMT soldering legs) configured to be mounted on the circuit board 50 by surface soldering as shown in FIG. 3B. Further, the electrical connecting portions 114 may also be contact protrusions formed by mechanically stamping a portion of the first shielding shell 110 and configured to be electrically connected to the circuit board 50 by pressure contact as shown in FIG. 3C.

Figure 4:
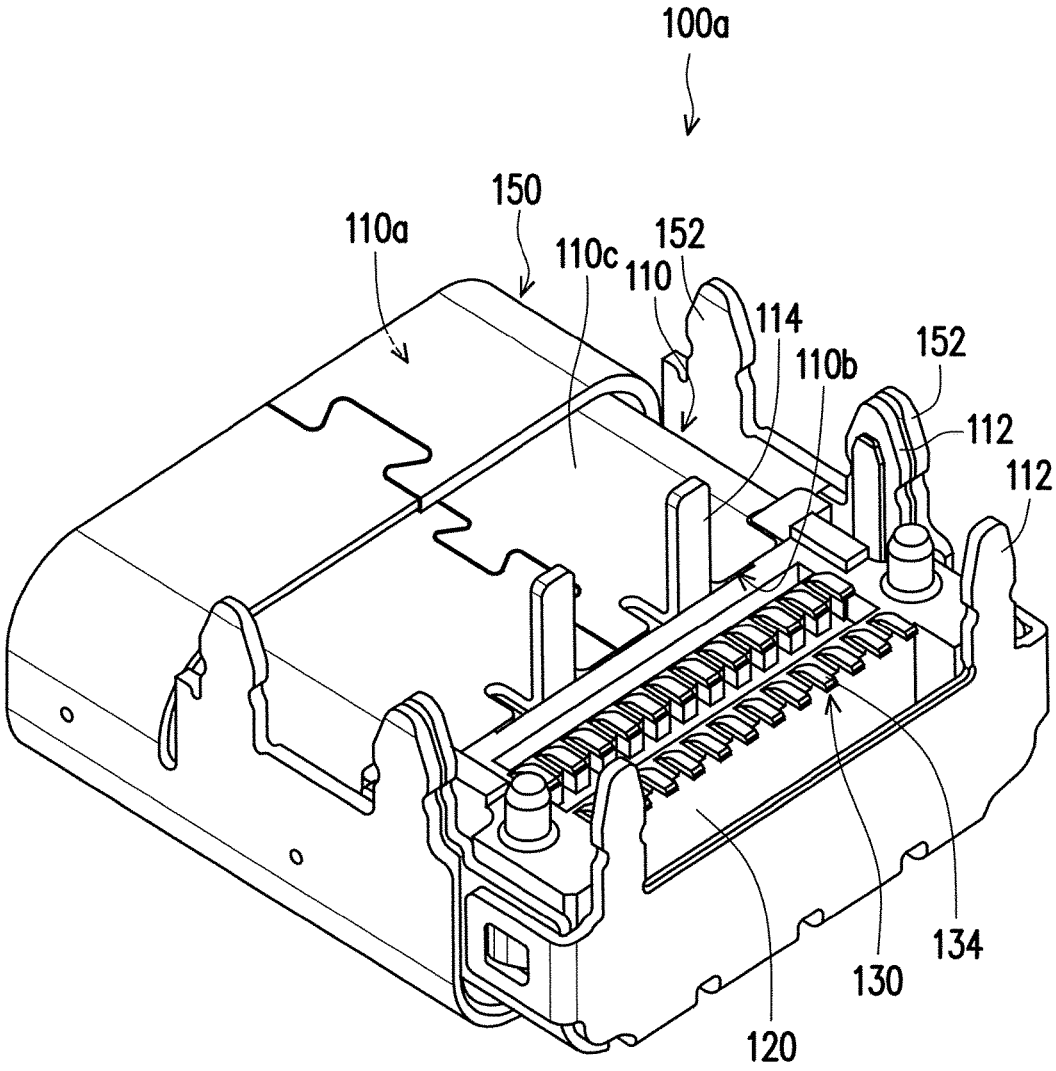
FIG. 4 is a perspective view of an electrical receptacle connector according to another embodiment of the invention.

Referring to FIG. 4, as compared with the embodiment of FIG. 1, in this embodiment of FIG. 4, an electrical receptacle connector 100*a* further includes a second shielding shell 150. The second shielding shell 150 surrounds the first shielding shell 110 and has a plurality of second soldering legs 152. The second soldering legs 152 are located on two opposite sides of the first shielding shell 110. The first soldering legs 112 and the second soldering legs 152 are both located around the first shielding shell 110. The electrical connecting portions 114 are located at the middle of the first shielding shell 110 and closer to the bottom opening 110*b* than to the front opening 110*a*, namely, closer to the soldering segment 134 of the terminal 130.

Figure 5:
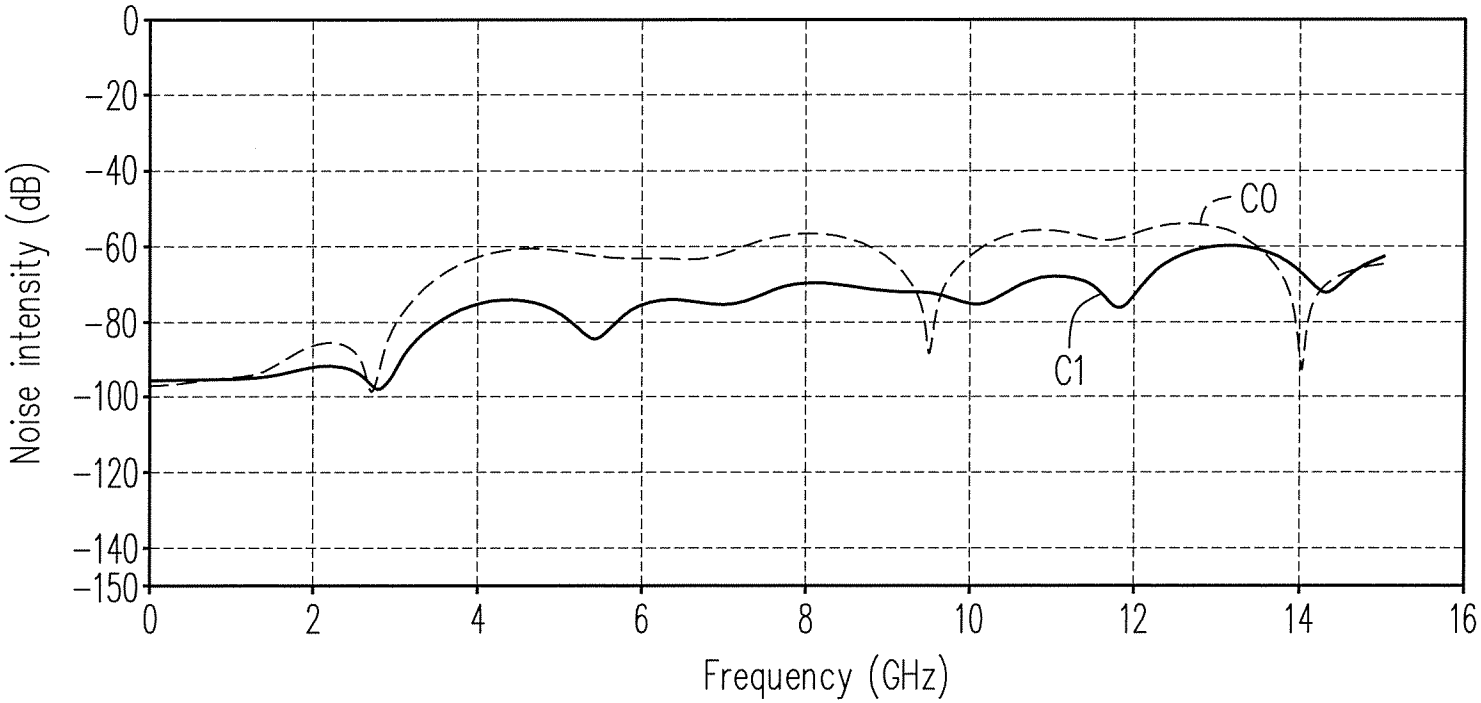
FIG. 5 is a curve diagram of noise intensity and frequency of the electrical receptacle connector of FIG. 4 with or without an electrical connecting portion on a first shielding shell thereof.

Referring to FIG. 5, a curve C0 indicates noise intensity of the electrical receptacle connector 100 of FIG. 4 with the electrical connecting portions 114 removed therefrom under testing using a differential mode signal at different frequencies, and a curve C1 indicates noise intensity of the electrical receptacle connector 100 of FIG. 4 with the electrical connecting portions 114 retained thereon under testing using a differential mode signal at different frequencies. Compared with the curve C0 indicating that the electrical connecting portions 114 have been removed, the curve C1 indicating that the electrical connecting portions 114 are retained has lower noise intensity at most frequencies.

Figure 6:
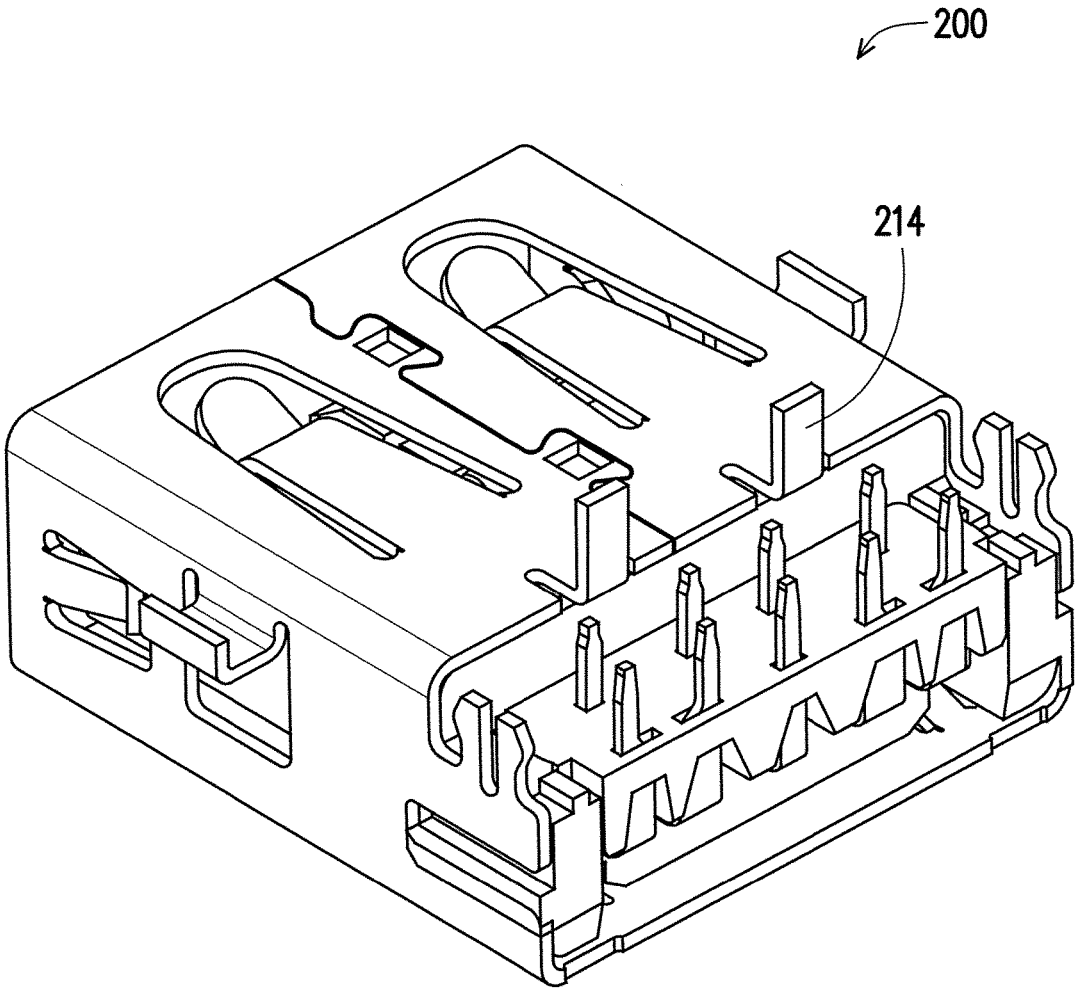
FIG. 6 is a perspective view of an electrical receptacle connector according to yet another embodiment of the invention.

In addition to the USB TYPE-C embodiment of FIG. 5, the invention may also be applied to a USB TYPE-A electrical receptacle connector 200 as shown in FIG. 6. An electrical connecting portion 214 of the electrical receptacle connector 200 has the same structural configuration and the same choice of forms as the electrical connecting portions 114 of the electrical receptacle connector 100 of FIG. 1.

In the above embodiments, the electrical connecting portions 114 are shown in plurality for schematic purposes. However, in another embodiment not shown, the electrical connecting portions 114 may also be only one, and also be conducive to shortening the low-impedance path of interference currents so as to reduce EMI noise.

To sum up, in the invention, the shielding shell (namely, the first shielding shell) of the electrical receptacle connector has one or a plurality of electrical connecting portions located between the front opening and the bottom opening of the shielding shell, and closer to the bottom opening and the soldering segment. The electrical connecting portion is conducive to shortening the low-impedance path of interference currents so as to reduce EMI noise.

It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. An electrical receptacle connector adapted to be mounted on a circuit board, comprising:

a first shielding shell having a front opening, a bottom opening and an electrical connecting portion, wherein the electrical connecting portion is located between the front opening and the bottom opening and is adjacent to the bottom opening and wherein the electrical connecting portion is integrally formed with the first shielding shell and protrudes outside the first shielding shell, an insulating body disposed inside the first shielding shell and having a tongue, wherein the tongue is exposed to the front opening;

a plurality of terminals disposed at the insulating body, wherein each of the terminals has a contact segment and a soldering segment, the contact segment is located on the tongue, and a shielding plate located inside the tongue and disposed between the contact segments of the double rows of the terminals, wherein the contact segments of the double rows of the terminals are disposed on an upper surface of the tongue and a lower surface of the tongue.

2. The electrical receptacle connector according to claim 1, wherein the first shielding shell further has a bottom wall, the bottom wall is located between the front opening and the bottom opening and faces the circuit board, and the electrical connecting portion is located on the bottom wall and is integrally formed with the bottom wall.

3. The electrical receptacle connector according to claim 2, wherein the electrical connecting portion is extended from an edge of the bottom wall, wherein the edge of the bottom wall is adjacent to the bottom opening.

4. The electrical receptacle connector according to claim 1, wherein the soldering segment is extended out the insulating body, exposed to the bottom opening and arranged in double rows.

5. The electrical receptacle connector according to claim 1, wherein the electrical connecting portion is in the form of a vertical soldering leg, a horizontal soldering leg or a contact protrusion.

6. The electrical receptacle connector according to claim 1, wherein the first shielding shell further has a plurality of first soldering legs, and the first soldering legs and the electrical connecting portion are located around the bottom opening.

7. The electrical receptacle connector according to claim 1, further comprising: a second shielding shell surrounding the first shielding shell and having a plurality of second soldering legs, wherein the second soldering legs are located on two opposite sides of the first shielding shell.

8. The electrical receptacle connector according to claim 1, wherein the electrical receptacle connector complies with USB TYPE-C or USB TYPE-A specifications.

9. The electrical receptacle connector according to claim 4, wherein the electrical connecting portion is closer to the soldering segment than to the front opening.

10. An electrical receptacle connector adapted to be mounted on a circuit board, comprising:

a first shielding shell having a front opening, a bottom opening and an electrical connecting portion, wherein the first shielding shell further has a bottom wall, the bottom wall is located between the front opening and the bottom opening and faces the circuit board, and the electrical connecting portion is integrally formed with the first shielding shell and is extended downwardly from an edge of the bottom wall and wherein the electrical connecting portion protrudes lower than a surface of the bottom wall, an insulating body disposed inside the first shielding shell and having a tongue, wherein the tongue is exposed to the front opening;

a plurality of terminals disposed at the insulating body, wherein each of the terminals has a contact segment and a soldering segment, the contact segment is located on the tongue, and a shielding plate located inside the tongue and disposed between the contact segments of the double rows of the terminals, wherein the contact segments of the double rows of the terminals are disposed on an upper surface of the tongue and a lower surface of the tongue.

11. The electrical receptacle connector according to claim 10, wherein the soldering segment is extended out the insulating body, exposed to the bottom opening and arranged in double rows.

12. The electrical receptacle connector according to claim 10, wherein the electrical connecting portion is a vertical soldering lead which penetrates a hole of the circuit board.

13. The electrical receptacle connector according to claim 10, wherein the edge of the bottom wall is adjacent to the bottom opening.

* * * * *